US005993231A

United States Patent [19]

Hoolhorst

[11] Patent Number: 5,993,231

[45] Date of Patent: Nov. 30, 1999

[54] ELECTRIC CONNECTOR

[75] Inventor: Albert Hoolhorst, Be Aardenburg, Netherlands

[73] Assignee: Siemens Aktiengesellschaft, Munich, Germany

[21] Appl. No.: 09/158,247

[22] Filed: Sep. 22, 1998

Related U.S. Application Data

[63] Continuation of application No. PCT/DE97/00526, Mar. 14, 1997.

[51] Int. Cl.[6] ..... H01R 27/00

[52] U.S. Cl. ..... 439/218; 439/289

[58] Field of Search ..... 439/79, 660, 289, 439/218, 217, 284, 295

[56] References Cited

U.S. PATENT DOCUMENTS

| | | | |
|---|---|---|---|
| 4,703,986 | 11/1987 | McCornick | 439/289 |
| 5,306,163 | 4/1994 | Asakawa . | |
| 5,413,506 | 5/1995 | Thompson | 439/660 |

FOREIGN PATENT DOCUMENTS

| | | | |
|---|---|---|---|
| 0568971 | 11/1993 | European Pat. Off. . | |
| 0591723 | 4/1994 | European Pat. Off. . | |
| 0701303 | 3/1996 | European Pat. Off. . | |
| 1280477 | 7/1972 | United Kingdom | 439/284 |

*Primary Examiner*—Lincoln Donovan
*Assistant Examiner*—J. F. Duverne
*Attorney, Agent, or Firm*—Herbert L. Lerner; Laurence A. Greenberg

[57] ABSTRACT

An electric connector having at least one substantially striplike contact element includes a housing having a wall, a portion of the contact element extending from within the housing through the housing wall to the outside of the housing, and being formed thereat as a first flat contact extending along an outer side of the housing wall, the housing wall having, outside the housing, a recess formed therein and exposing at least parts of the contact element portion extending through the housing wall, the exposed contact element portion being formed at least partly as a second flat contact, and the recess being formed as a plug-in opening for a contact spring capable of contacting the second flat contact, the recess extending around the at least one contact element and having a portion thereof free of any contact element and formed so as to receive one of a pin and a strip of a counterconnector to be connected to the electric connector.

8 Claims, 5 Drawing Sheets

ELECTRIC CONNECTOR

CROSS-REFERENCE TO RELATED APPLICATION

This is a continuation of copending International Application PCT/DE97/00526, filed Mar. 14, 1997, which designated the United States.

BACKGROUND OF THE INVENTION

1. Field of the Invention

The invention relates to an electric connector including at least one substantially striplike contact element of which a portion extends from within a housing through a housing wall to the outside of the housing, and is formed thereat as a flat contact extending along an outer side of the housing wall, the housing wall having, outside the housing, a recess formed therein and exposing at least parts of the contact element portion extending through the housing wall, the exposed contact element portion being formed at least partly as a second flat contact, and the recess being formed as a plug-in opening for a contact spring capable of contacting the second flat contact.

Electric connectors of this general type are installed in mobile or cellular telephones, amongst others, so that they are able to be connected to automobile installation kits, hands-free facilities, chargers, earphones, microphones, and so forth.

Many embodiments of electric connectors which may be used for the purposes mentioned hereinabove have become known heretofore.

One possible embodiment of an electric connector which is usable for the aforementioned purposes has been described, for example, in the published European Patent Document EP 0,586,971 A1. The fundamental principle of such an electric connector is illustrated in FIGS. 6A and 6B shown herein. The relevant electric connector being, respectively, the upper or first connector identified by a reference numeral 110 in the illustrated connector arrangement. The first connector is connectable to a respective counterpart illustrated at the bottom of the aforementioned figures and formed as a second connector, the first and the second connectors being shown in unconnected condition in FIG. 6A, and in connected condition in FIG. 6B.

In the example of the aforementioned European patent document under consideration, the first connector is installed in a mobile telephone or cellular phone or the like, and the second connector is an integral part of a charger or the like.

The first connector has a striplike contact element, one end of which, in the example under consideration, is soldered, for example, by an SMT soldering method, to an electric printed board provided within a housing, i.e., a mobile housing and, simultaneously, a connector housing, and the other end of which extends outside the housing and forms thereat a flat contact that can be brought into contact with a corresponding contact spring of the second connector.

The contact spring of the second connector, in the unconnected condition of the connectors illustrated in FIG. 6A, partly projects out of a housing part, namely, the charger and, simultaneously, the second connector, through an opening formed in the latter. The salient part of the contact spring, i.e., the part thereof projecting from the housing, is pressable downwardly by pressure acting from above according to the representation in FIGS. 6A and 6B, in particular, due to elastic deformation of the lower part of the contact spring.

The pressure on the contact spring of the second connector may be exerted, for example, by pressing down thereon or, in the case of an appropriate dead weight, merely by placing the latter on the first electric connector or, more precisely, on the appliance or device containing the first electric connector. In the condition illustrated in FIG. 6B, the contact element or, more precisely, the flat contact of the contact element of the first connector, and the contact spring of the second connector are pressed against one another, thus making it possible to achieve a reliable electrical contact, if the contact springs and the contact locations, respectively, thereof are suitably constructed and oriented.

Mechanically loose electric connections, which are producible by the use of contact elements of this type, can be employed advantageously, in particular, when an appliance or device containing the first connector is only temporarily electrically connectable to and disconnectable from, respectively, an appliance or device containing the second connector, at any time without force, and primarily by merely laying the one on the other and lifting the one away from the other, respectively.

The mobile or portable telephones or cellular phones, also referred to hereinafter as mobiles, which are under consideration herein, require connecting possibilities which permit them to be connected quickly and easily to convenient automobile installation kits, desk charging stations, hands-free facilities and the like.

On the other hand, with regard to many appliances, in addition to the aforedescribed connection system which permits mechanically loose connections, there is a need for a further connector system which permits mechanically fixed connections, such as, for example, a plug connector system or the like, so that electric connections can be made permitting the formation of a mechanical connection between the connectors to be connected, which cannot unintentionally or easily be separated.

In the mobiles under consideration, this is necessary so that simple automobile installation kits, chargers, earphones, microphones and the like can be connected.

It is believed to be readily apparent, and does not need to be explained any further, that the aforementioned connection systems are suitable, respectively, only for a quite specific purpose, namely to make either a mechanically loose or a mechanically fixed connection, and are unable to serve as even only an approximately equivalent replacement for the other connection system, respectively. On the other hand, the provision of several possibilities of connection for the input and reception, respectively, of the same signals requires a relatively large amount of space, and this runs counter to the constant endeavor to reduce the size of articles of all types.

An electric connector by which both mechanically loose and mechanically fixed connections can be made has become known heretofore from the published European Patent Document EP-A-0 701 303. Electric connectors of this type, though of small size, may have a large number of contact elements contactable by various kinds of counter-connectors. It may prove to be problematical, however, to contact the contact elements reliably and gently therefor and for the electric connectors under all circumstances.

SUMMARY OF THE INVENTION

It is accordingly an object of the invention to provide an electric connector of the type described in the introduction hereto wherein the contact elements thereof can be contacted under all circumstances reliably and gently therefor and for the electric connector.

With the foregoing and other objects in view, there is provided, in accordance with the invention, an electric connector having at least one substantially striplike contact element, comprising a housing having a wall, a portion of the contact element extending from within the housing through the housing wall to the outside of the housing, and being formed thereat as a first flat contact extending along an outer side of the housing wall, the housing wall having, outside the housing, a recess formed therein and exposing at least parts of the contact element portion extending through the housing wall, the exposed contact element portion being formed at least partly as a second flat contact, and the recess being formed as a plug-in opening for a contact spring capable of contacting the second flat contact, the recess extending around the at least one contact element and having a portion thereof free of any contact element and formed so as to receive one of a pin and a strip of a counterconnector to be connected to the electric connector.

In accordance with another feature of the invention, the housing wall is formed by an insulating body of the electric connector.

In accordance with a further feature of the invention, the housing wall is simultaneously a housing wall of an appliance containing the electric connector.

In accordance with an added feature of the invention, the contact element portion extending along the outer side of the housing wall, and the contact element portion extending through the housing wall are oriented so as to be bent substantially perpendicularly to one another.

In accordance with an additional feature of the invention, the first flat contact formed on the contact element portion extending along the outer side of the housing wall is able to be contacted by an axially resilient contact spring of the counterconnector.

In accordance with yet another feature of the invention, the second flat contact formed on the contact element portion extending through the housing wall is able to be contacted by a laterally resilient contact spring of the counterconnector.

In accordance with yet a further feature of the invention, the contact element portions of a plurality of contact elements extending through the housing wall are exposed by the recess.

In accordance with a concomitant feature of the invention, the at least one contact element is formed as a metallized plastic-material region in the housing, which is an electrically nonconductive plastic-material housing.

It is thereby possible, even during a careless procedure, to contact in a relatively simple manner the contact elements of the electric connector reliably and gently both for the contact elements and the electric connector.

Other features which are considered as characteristic for the invention are set forth in the appended claims.

Although the invention is illustrated and described herein as embodied in an electric connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENT

Figure 1B:
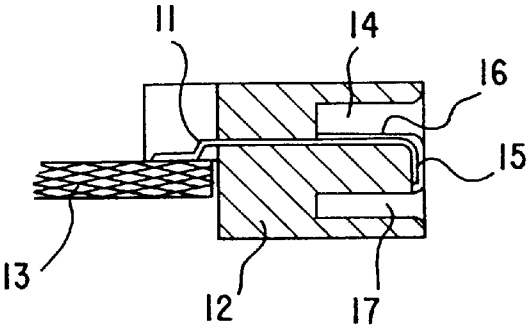
FIGS. 1A, 1B and 1C, respectively, are a front elevational view of a first exemplary embodiment of an electric connector according to the invention of the instant application, a cross-sectional view of FIG. 1A taken along the line A—A in the direction of the arrows, and a sectional view of FIG. 1A taken along the line B—B in the direction of the arrows.
Figure 1A:
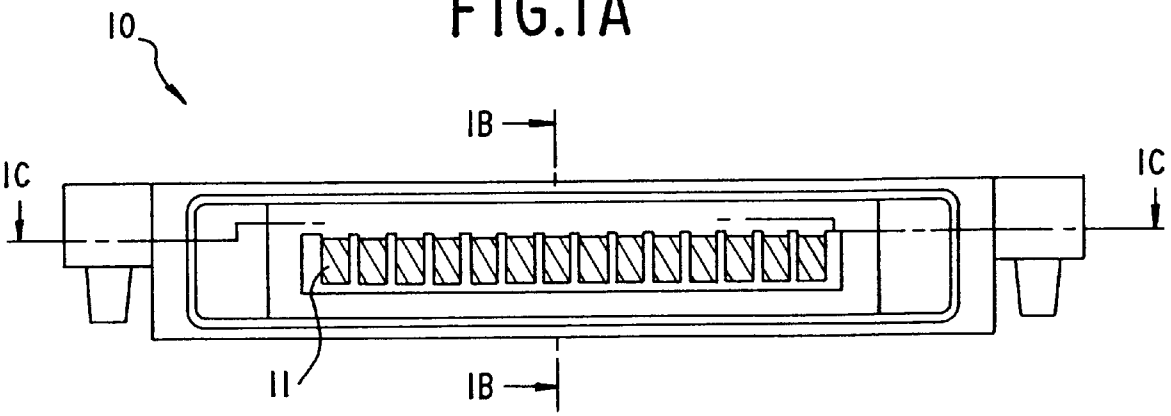
Figure 1C:
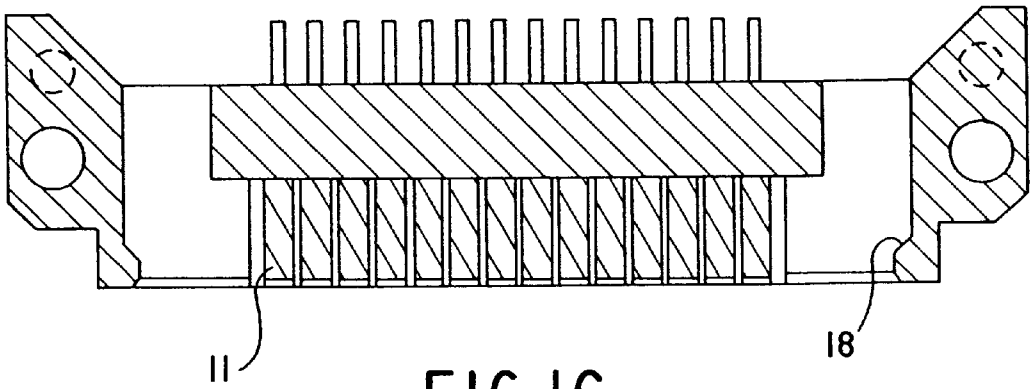

Referring now to the drawings and, first, particularly, to FIGS. 1A to 1C thereof, there is shown therein a first exemplary embodiment of the electric connector according to the invention. As noted hereinbefore, FIG. 1A is a front elevational view, i.e., a plan view of the connector face, of the electric connector, FIG. 1B a sectional view of FIG. 1A taken along the line A—A, and FIG. 1C a sectional view of FIG. 1A taken along the line B—B.

As is evident particularly from FIGS. 1A and 1C, the electric connector 10 shown in FIGS. 1A to 1C has a multiplicity of substantially striplike contact elements or contact strips 11 lying adjacent to one another. As is apparent from FIG. 1B, each of the contact elements 11 extends through an insulating body, namely an electrically nonconductive housing wall 12 of the connector 10. Within the housing defined by the housing wall 12, as shown at the lefthand side of FIG. 1B, the contact element 11 is connected to a printed electric circuit board 13, for example, by an SMT soldering method; for this purpose, the corresponding portion of the contact element 11 is formed as an SMT soldering tag, i.e., so as to be comparatively narrow, as is evident from FIG. 1C.

The contact element 11 extends from the location at which it is connected to the printed circuit board 13 virtually directly to the housing wall 12 and has a portion 16 thereof which passes through the latter, as much as possible, in a straight line and along the shortest path. When it emerges at the opposite side of the housing wall 12, i.e., when it reaches the outside of the housing shown at the righthand side of FIG. 1B, the contact element 11 is bent approximately rectangularly and a portion 15 thereof extends somewhat farther along the outer side of the housing wall 12. This contact element portion 15 extending along the outer side of the housing wall 12 is formed as a first flat contact and a substantially planar end-face contact location, respectively.

As is evident once again, particularly from FIG. 1B, the housing wall 12 is formed with a recess 14 extending inwardly from outside the housing. The recess 14 is positioned and formed so that it extends substantially parallel to that portion 16 of the contact element 11 which passes through the housing wall 12 and simultaneously partly exposes the portion 16, which is at least partly formed as a second flat contact and a substantially planar lateral contact location, respectively. Furthermore, the recess 14 is formed as a plug-in opening for a contact spring described in greater detail hereinafter which, when in the inserted or plugged-in condition, as intended, can contact the lateral contact location or site 16.

The contact locations or sites of the contact element 11, i.e., the end-face contact site 15 and the lateral contact site 16, as may already be presumed from the different arrangement and orientation thereof, afford various possibilities for connecting the connector 10 to a matching part or counterpart. These various connection possibilities and possible embodiments of corresponding counterparts or matching parts to the electric connector shown in FIGS. 1A to 1C are described hereinbelow with reference to FIGS. 2A and 2B.

Figure 2A:
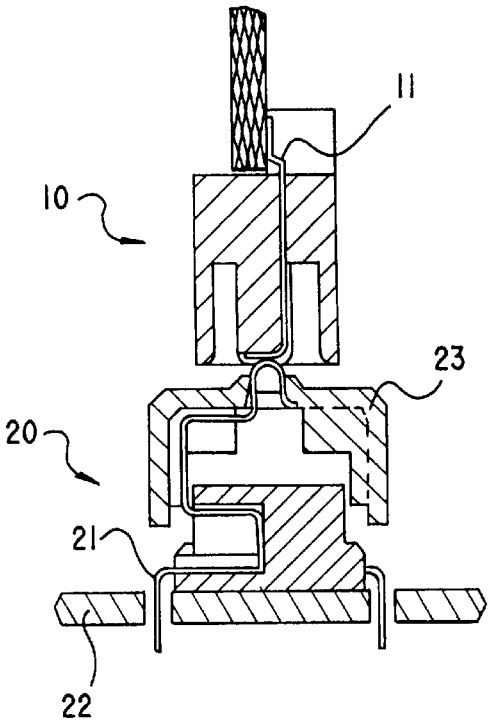
FIGS. 2A and 2B are views of FIG. 1B shown rotated through 180° and illustrating various connection possibilities afforded by the electric connector.

FIG. 2A illustrates the contacting of the end-face contact site 15 of the electric connector 10 with a corresponding counterpart 20.

The counterpart 20 has a contact element in the form of a contact spring 21. The contact spring 21 is connected to a printed electric circuit board 22 and extends away from the latter in a substantially meander-like path; the contact spring 21, on a section thereof most distal from the printed circuit board 22, has a dome or arch which projects through a recess formed in a movable housing part 23 of the counterpart 20. This arch of the contact spring 21 of the counterpart 20 is that portion of the contact spring 21 which, when a connection is made, as intended, comes into contact with the end-face contact location or site 15 of the electric connector 10 shown in FIG. 1.

FIG. 2A illustrates a condition wherein the contact elements 11 and 21 of an electric connector 10 and a counterpart 20 are just in contact with one another. When the connector 10 and the counterpart 20 are pressed further against one another, the arch-bearing section of the contact spring 21 of the counterpart 20, together with the movable housing part 23, moves back elastically, while simultaneously pressing the lower meander-like section of the contact spring 21 together, the backward movement being limitable to a given minimum by conventional stop devices.

When the connector 10 and the counterpart 20 are in a condition, i.e., a connection condition, wherein they are pressed more or less firmly against one another, an axially resilient contact spring, namely the contact spring 21 of the counterpart 20 presses substantially frontally against a flat contact, namely the end-face contact site 15 of the electric connector 10.

The electric connector 10 and an appliance containing it, respectively, can be brought into contact with the counterpart 20 merely by placing it upon the latter, if the dead weight of the electric connector 10 and the appliance containing it, respectively, and the rigidity of the contact springs of the counterpart 20 are appropriately coordinated.

A connection of this type is an electrically reliable and firm, but mechanically loose, connection, that is, the electric connector 10 and the counterpart 20 may at any time be, respectively, connected force-free to and separated from one another, simply by being placed on or lifted off one another.

Figure 2B:
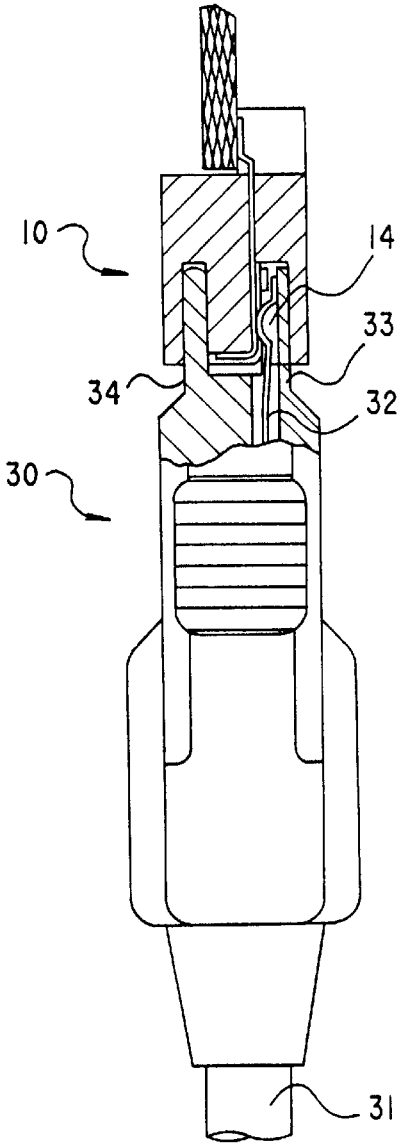

The second connection possibility, which is completely different from that of the foregoing, is more precisely the contacting of the lateral contact site 16 of the connector 10 by a corresponding counterpart 30, as illustrated in FIG. 2B.

The counterpart 30 is an electric connector which is connected to an electric cable 31. The counterpart 30 has a contact spring 32 which, for stabilizing it in the axial direction, i.e., in the insertion direction, may be fastened partly to a housing extension or projection 33 extending likewise in the axial direction. The contact spring 32 and the housing extension 33 are constructed and dimensioned in a manner that they can be inserted into the recess 14 formed in the electric connector 10. In this regard, the contact spring 32 is prestressed and shaped, i.e., bent, so that when it is, respectively, inserted and pushed into the recess 14, it is elastically deformed, i.e., laterally compressed, and, in the condition wherein it is, respectively, inserted or pushed into the recess 14, presses substantially frontally against the lateral contact site 16 of the electric connector 10.

The insertion of the counterpart 30 into the electric connector 10, more precisely the insertion of the contact spring 32 and the housing extension 33 of the counterpart 30 into the recess 14 of the electric connector 10, which serves as an insertion orifice, while deforming the contact spring 32 and with a deformed contact spring 32, respectively, is an operation which requires a given expenditure of force. This applies accordingly, as well, to the separation of the plug connection. The connection resulting from the contacting of the lateral contact site 16 of the electric connector 10 therefore ensures not only a reliable electrical connection of the connectors to be contacted, but also a mechanical connection thereof which is fixed, i.e., can be inadvertently released only with difficulty or at least not readily.

Moreover, in the condition wherein the electric connector 10 and the counterpart 20 are plugged together, as intended, they can be stopped or held by one another. For this purpose, the electric connector 10 is formed with an undercut 18, as shown in FIG. 1C, wherein the counterpart 20 can be locked or can engage.

In order to achieve increased stability of the connector arrangement and improved guidance of the connectors when they are being plugged together and separated, the electric connector 10, more precisely the housing wall 12 thereof which is under consideration, is formed with a second recess 17 which, like the first recess 14, likewise extends from outside the housing into the housing wall 12. This second recess 17 is located on that side of the contact element 11 which faces away from the first recess 14, but at some distance from the contact element 11, however, without exposing the latter or parts thereof. A second housing projection or extension 34 of the counterpart 30 can engage in the second recess 17 formed in the electric connector 10 when the electric connector and the counterpart 20 are being plugged together.

In the illustrated exemplary embodiment, the second housing extension 34 has only a guidance function, i.e., it is not a carrier of contact springs like the first housing extension 33. If required, however, this may be changed, i.e., if required, it is possible to lengthen the contact element 11 of the electric connector 10 so that it extends into the second recess 17, and it is likewise possible to provide the second housing extension 34, like the first housing extension 33, with a corresponding contact spring.

In order for the housing extensions 33 and 34 of the counterpart 30 to be given sufficient stability or rigidity, they are preferably not constructed, for example, as a number of separate pins corresponding to the number of contact springs which are provided, but as a continuous strip common to all of the contact springs. The recesses 14 and 17 of the connector 10 must, of course, be constructed correspondingly.

In the exemplary embodiment under consideration, the recesses 14 and 17 are partial recesses and parts of a single recess, respectively, extending around the contact elements 11.

As described hereinabove with reference to FIGS. 2A and 2B, the electric connector shown in FIGS. 1A to 1C may be contacted selectively according to one of two different connection possibilities. Depending upon the connection possibility which is selected, the connections are mechanically loose (FIG. 2A) or mechanically fixed (FIG. 2B).

The counterpart to be connected to the connector 10 may also be constructed so that some of the contact elements 11 are contacted as in FIG. 2A, and the remaining contact elements 11 are contacted as in FIG. 2B. Any desired intermediate stages between a mechanically loose and a mechanically fixed connection can be implemented in this manner.

The connection possibilities which are described hereinbefore have in common the fact that, in each case, they make a reliable and good electric connection possible. Should the quality of electric connections of this type nevertheless not meet the established or set requirements, there may be provision for constructing the counterpart to the electric connector in such a way that selected individual, several or all of the contact elements 11 of the electric connector 10 are contacted both at the end-face contact site 15 thereof and at the lateral contact site 16 thereof and the several lateral contact sites, respectively, when the contacting is in the recesses 14 and 17. Contacting of this type, which is implemented simultaneously in accordance with entirely different connection principles, is of extremely high quality and can virtually no longer be interrupted by vibrations or the like.

Figure 3B:
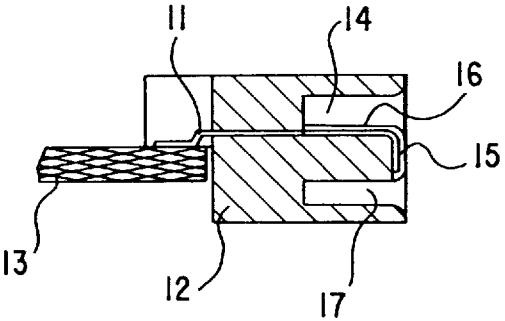
FIGS. 3A, 3B and 3C, respectively, are views, like those of FIGS. 1A, 1B and 1C, of a second exemplary embodiment of the electric conductor.
Figure 3A:
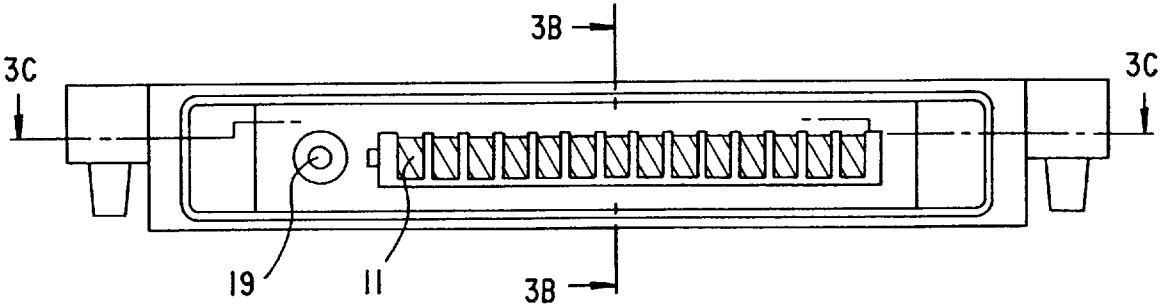
Figure 3C:
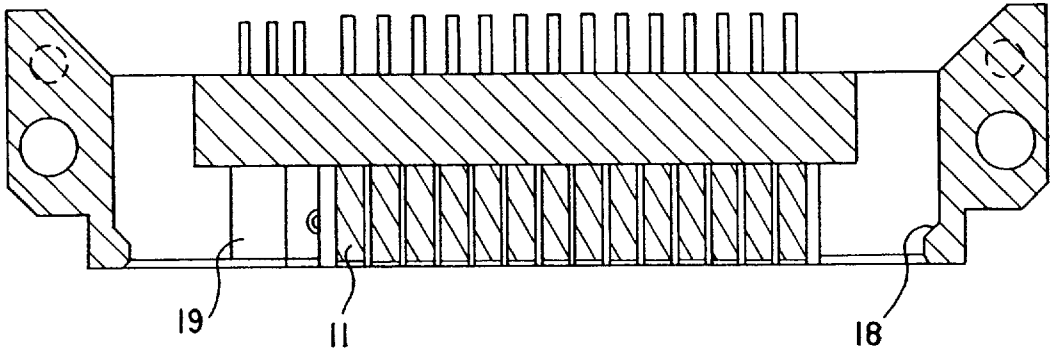

A further exemplary embodiment of the electric connector according to the invention is illustrated in FIGS. 3A to 3C, of which, FIG. 3A is a front elevational view of the electric connector, i.e., a plan view of the connector face, FIG. 3B is a cross-sectional view of FIG. 3A taken along the line A—A, and FIG. 3C is a sectional view of FIG. 3A taken along the line B—B.

The electrical connector shown in FIGS. 3A to 3C corresponds very markedly to the electric connector 10 described with reference to FIGS. 1A, 1B, 1C, 2A and 2B, in that like reference numerals identify identical features, and statements or comments made hereinbefore regarding FIGS. 1A, 1B, 1C, 2A and 2B apply accordingly to the electric connector shown in FIGS. 3A, 3B and 3C.

The only difference between the electric connectors shown in all of the aforementioned figures is that the electric connector according to FIGS. 3A, 3B and 3C additionally has a terminal 19 for a coaxial line suitable for radio-frequency signal transmission (antenna signal transmission). As is evident particularly from FIG. 3A, this terminal 19 is located laterally next to the row of contact elements 11, which has been described in detail hereinbefore, and in only a most minimal manner impairs the functioning or capability for intended use of the contact elements 11.

Figure 4A:
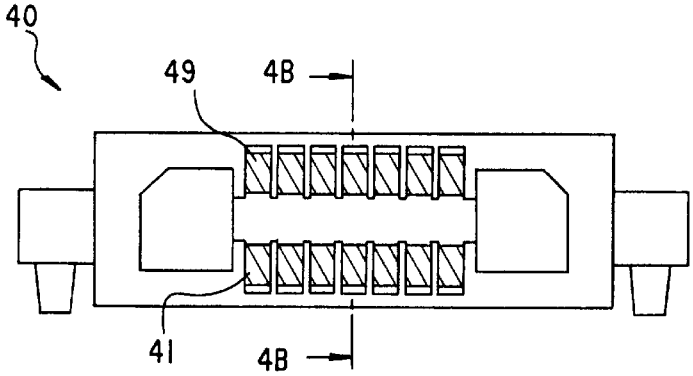
FIGS. 4A and 4B, respectively, are views, like those of FIGS. 1A and 1B, for example, of a third exemplary embodiment of the electric connector.
Figure 4B:
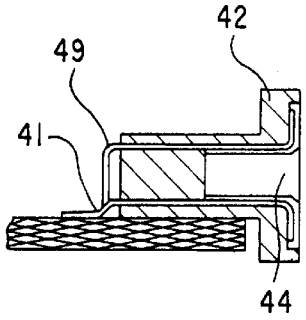

A further exemplary embodiment of the electric connector according to the invention is shown in FIGS. 4A and 4B, of which FIG. 4A is a front elevational view of the electric connector, i.e., a plan view of the connector face, and FIG. 4B is a cross-sectional view of FIG. 4*a* taken along the line A—A.

The electric connector shown in FIGS. 4A and 4B is identified by reference numeral 40. Identically with the electric connector 10 shown in FIGS. 1A, 1B and 1C, the electric connector 40 has substantially striplike contact elements 41 which are constructed and used in the same manner as the contact elements 11 of the electric connector 10 shown in FIGS. 1A, 1B and 1C. With respect to the details thereof, therefore, attention is drawn to the parts of this specification referring to FIGS. 1A, 1B, 1C, 2A and 2B. Also, identically with the electric connector 10 shown in FIGS. 1A, 1B and 1C, the electric connector 40 shown in FIGS. 4A and 4B is provided with a recess 44 which is formed in the housing wall 42.

In contrast with the electric connector 10, however, the electric connector 40 has two rows of contact elements 41 lying above one another, the thus newly added upper row being formed by additional contact elements 49 which, however, likewise correspond substantially to the contact elements 11 and merely extend through the housing wall 42 at another location. The location at which they extend or are led through the housing wall 42 corresponds to that edge of the recess 44 which is an upper edge as viewed in FIG. 4B. In this regard, the contact elements 49 extend through the housing wall 42, in a manner similar to that for the contact elements 41, so that they are partly exposed by the recess 44. The recess 44, at locations opposite one another, accordingly has portions or sections of various contact elements 41, 49 of the electric connector 40, which are exposed and which are constructed, respectively, as flat contacts.

In the case of a corresponding construction of a non-illustrated counterpart which is to be connected to the electric connector 40, two contact sites or locations of different contact elements may be contacted per plug location, i.e., per recess 44. Both the upper contact row, as viewed in FIG. 4A, and the lower contact row, as viewed in FIG. 4A, may be contacted independently of one another at the respective lateral contact sites thereof within the recesses 44, the contact sites being arranged and formed as in the electric connector according to FIGS. 1A, 1B and 1C, and/or at the respective end-face contact sites thereof, likewise arranged and formed as in the electric connector according to FIGS. 1A, 1B and 1C.

Because two contact springs may have to be inserted into the recess 44 according to FIGS. 4A and 4B, as required, the recess 44 will have to be formed larger, in a manner like the corresponding recess 14 according to FIGS. 1A, 1B and 1C.

The several contact elements 41, 49 extending through the recess 44 can be connected electrically to one another, in order to ensure a particularly reliable electric connection to a corresponding counterpart to the electric connector 40. They may, however, also be formed as line paths carrying various signals, so that a contact density which is as high as possible can be achieved. In the last-mentioned case, it is necessary to insulate the contact springs to be inserted into the recess 44 for contacting the contact sites provided thereat. An insulating effect may be achieved, for example, by providing the corresponding contact springs on different sides of a strip, or corresponding number of pins, which come to rest centrally in the recess 44 in the inserted condition.

Figure 5A:
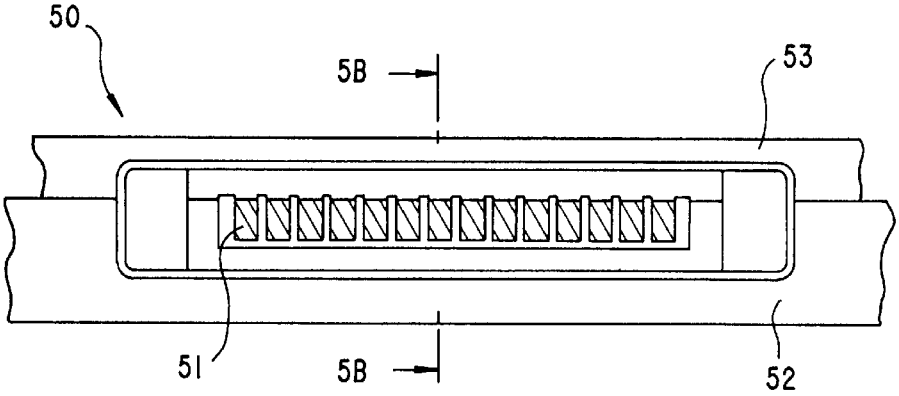
FIGS. 5A and 5B, respectively, are views, like those of FIGS. 1A and 1B, for example, of an advantageous form of the electric connector according to the invention, which is designed for use or installation in a mobile or cellular telephone.
Figure 5B:
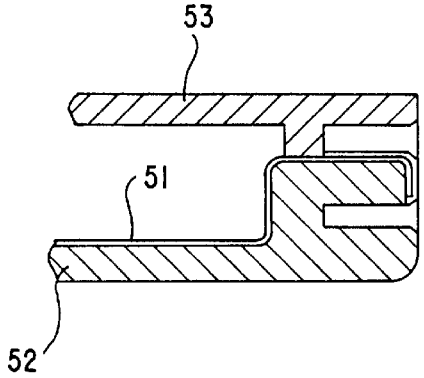
Figure 6B:
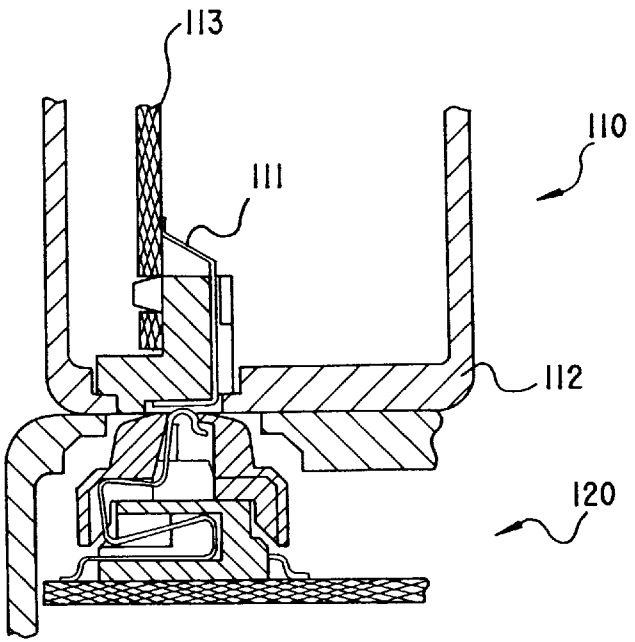
FIG.6B PRIOR ART
FIGS. 6A and 6B are sectional views of a conventional connector arrangement in different phases of formation.
Figure 6A:
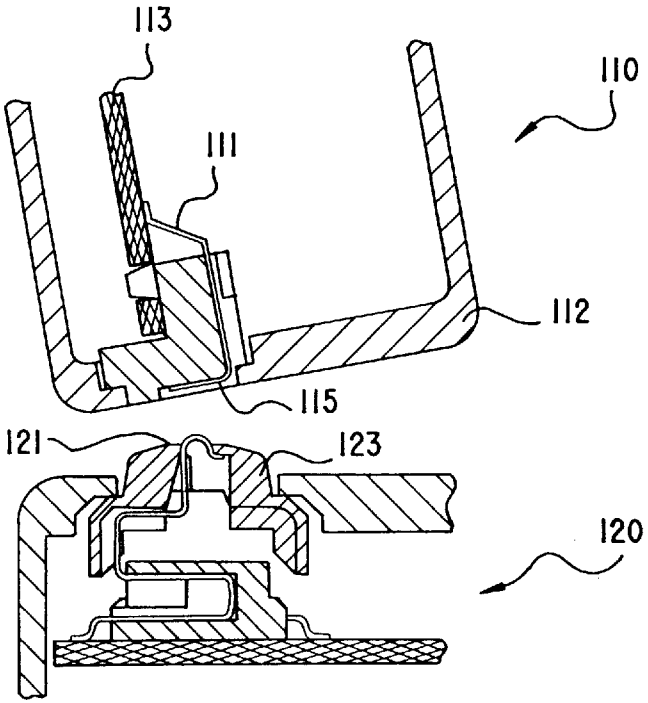
FIG.6A PRIOR ART

Finally, with reference to FIGS. 5A and 5B, there is shown therein an advantageous embodiment of the electric connector according to the invention for use in an electric appliance, such as a mobile or cellular telephone or the like, a particular, though non-exclusive, feature of which inter alia being the integration of the electric connector into the appliance housing, it being noted that the electric connectors described hereinbefore being separate components which can be mounted at the desired location through the use of fastening flanges, screw holes, and so forth, which are provided thereon. Of the FIGS. 5A and 5B, FIG. 5A is a front elevational view, or a plan view of the connector face, of an electric connector integrated into a mobile or cellular telephone housing, and FIG. 5B is a sectional view of FIG. 5A taken along the line A—A.

As is evident particularly from FIG. 5B, the electric connector 50 includes a contact element 51 and a mobile or cellular telephone housing 52, 53, serving simultaneously as a connector housing, which are of such construction that the connector 50, like the connectors described hereinbefore, can be contacted selectively via an end-face contact site or via a lateral contact site. With regard to the basic construction of the electric connector 50 to be provided for this purpose, reference may be had to the description of the electric connectors presented hereinbefore in this specification.

Contrasting with the connectors described hereinbefore, however, the housing of the connector 50, as shown in FIG. 5B, is of multipartite construction, and the contact element 51 extends along a joint abutment between the housing parts 52 and 53 from within the housing, through the housing wall, and to the outside of the housing.

The two housing parts 52 and 53 are a main housing part 52 and a removable cover 53 of a mobile or cellular telephone, the housing parts 52 and 53 being formed of electrically nonconductive plastic material.

With the cover 53 removed, the region along which the contact element or contact strip 51 is provided and is to be provided, respectively, is freely accessible to a full extent, i.e., is not covered by anything. The contact element 51 can consequently be produced in a particularly simple manner here. In particular, free access to the contact element region makes it possible to integrate the contact elements into the main housing 52 by providing the material of the main housing 52 with locally altered properties, more exactly by providing metallized plastic-material regions within the basically electrically nonconductive main housing 52, for example, in accordance with so-called MID-technology.

The metallized plastic-material regions may be formed in various ways.

One of the possibilities is to initially produce metallized plastic-material zones (a metallized plastic-material framework or skeleton) and to subsequently inject nonmetallized plastic material, at least partly, around the metallized zones. According to another possibility, a housing blank formed of metallizable and nonmetallizable plastic-material portions can be produced initially, and the housing blank can then be metallized subsequently, the metallization being able to take place only at the locations of metallizable plastic material. A further possibility is partial metallization according to the so-called SIL-method.

A contact element construction of this type simplifies the production of the electric connector in that only a very small number of individual parts have to be assembled, and increases the reliability of the electric connector by ensuring a completely rigid and unreleasable connection of the contact elements to the housing.

The electric connector according to the invention can therefore not only be used extremely flexibly, but simultaneously reliably and lastingly ensures electric connections of extremely high quality and is, furthermore, also simple and inexpensive to produce.

I claim:

1. An electric connector having at least one contact element with a substantially striplike shape, comprising:

a housing having a wall with an outer side; and at least one contact element with a substantially striplike shape;

said contact element having a portion extending through said housing to said outer side of said wall of said housing, and being formed thereat as a first flat contact extending along said outer side of said housing wall;

said housing having a first recess formed therein, said first recess extending through said outer side of said housing wall and exposing at least parts of said contact element portion extending through said housing, said exposed contact element portion being formed at least partly as a second flat contact, said first recess being formed as a plug-in opening for a contact spring capable of contacting said second flat contact, and said first recess extending around said contact element; and said housing having a second recess formed therein opposite said first recess and extending through said outer side of said housing wall, said second recess being free of any contact element and formed so as to receive one of a pin and a strip of a counterconnector to be connected to the electric connector so that the received one of the pin and the strip of the counterconnector does not electrically contact said contact element.

2. The electric connector according to claim 1, wherein said housing wall is formed by an insulating body of the electric connector.

3. The electric connector according to claim 1, wherein said housing wall is simultaneously a housing wall of an appliance containing the electric connector.

4. The electric connector according to claim 1, wherein the contact element portion extending along said outer side of said housing wall, and the contact element portion extending through said housing are oriented so as to be bent substantially perpendicularly to one another.

5. The electric connector according to claim 1, wherein said first flat contact formed on the contact element portion extending along said outer side of said wall is able to be contacted by an axially resilient contact spring of the counterconnector.

6. The electric connector according to claim 1, wherein said second flat contact formed on the contact element portion extending through said housing is able to be contacted by a laterally resilient contact spring of the counterconnector.

7. The electric connector according to claim 1, wherein the contact element portions of a plurality of contact elements extending through said housing are exposed by the recess.

8. The electric connector according to claim 1, wherein said housing is formed of an electrically nonconductive plastic material, and the at least one contact element is formed as a metallized plastic-material region in said housing.

* * * * *